United States Patent [19]

Conley

[11] 3,985,060

[45] Oct. 12, 1976

[54] AMMUNITION MAGAZINE FOR AUTOMATIC FIREARMS

[75] Inventor: James F. Conley, Kennebunk, Maine

[73] Assignee: Maremont Corporation, Saco, Maine

[22] Filed: Sept. 16, 1975

[21] Appl. No.: 614,023

Related U.S. Application Data

[62] Division of Ser. No. 507,997, Sept. 20, 1974.

[52] U.S. Cl. ..... 89/34

[51] Int. Cl.[2] ..... F41D 9/02

[58] Field of Search..... 89/33 B, 33 BA, 33 BB, 89/33 BC, 34; 206/3; 42/50

[56] References Cited

UNITED STATES PATENTS

| | | | |
|---|---|---|---|
| 1,800,595 | 4/1931 | Browning | 89/33 BB |
| 3,562,944 | 2/1971 | Wagner et al. | 42/50 |

FOREIGN PATENTS OR APPLICATIONS

| | | | |
|---|---|---|---|
| 221,029 | 11/1957 | Australia | 89/34 |

OTHER PUBLICATIONS

Clair Rees, "The Steyr–Mannlicher Rifles," Guns, June 1974, p. 70.

*Primary Examiner*—Stephen C. Bentley
*Attorney, Agent, or Firm*—Mason, Fenwick & Lawrence

[57] ABSTRACT

An ammunition magazine for storing rounds of ammunition for a belt-fed, gas-operated, air cooled automatic firearm having a novel mechanism for transferring link-connected ammunition rounds from the ammunition magazine to a feed position in the automatic firearm. The magazine includes an open-ending housing having side and end walls defining a chamber for housing the link connected ammunition and a removable cover retained by novel lock structure and having a novel feed outlet mechanism for regulating the position of an ammunition belt for the link connected ammunition rounds.

10 Claims, 17 Drawing Figures

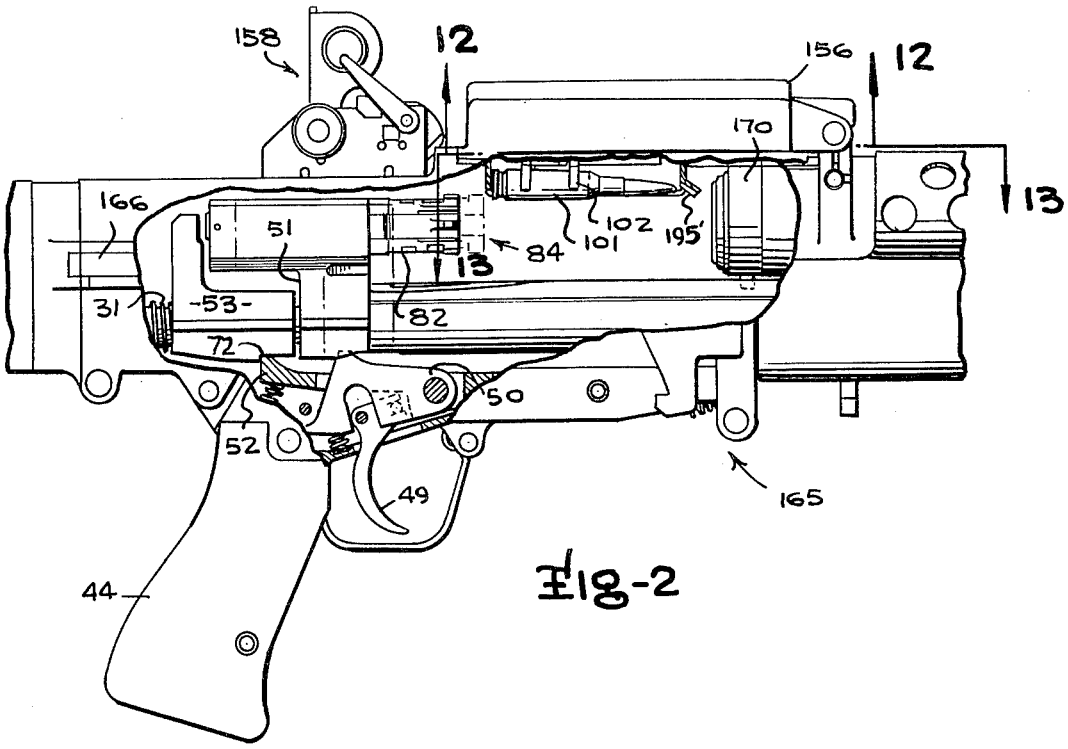
Fig-2
Fig-3
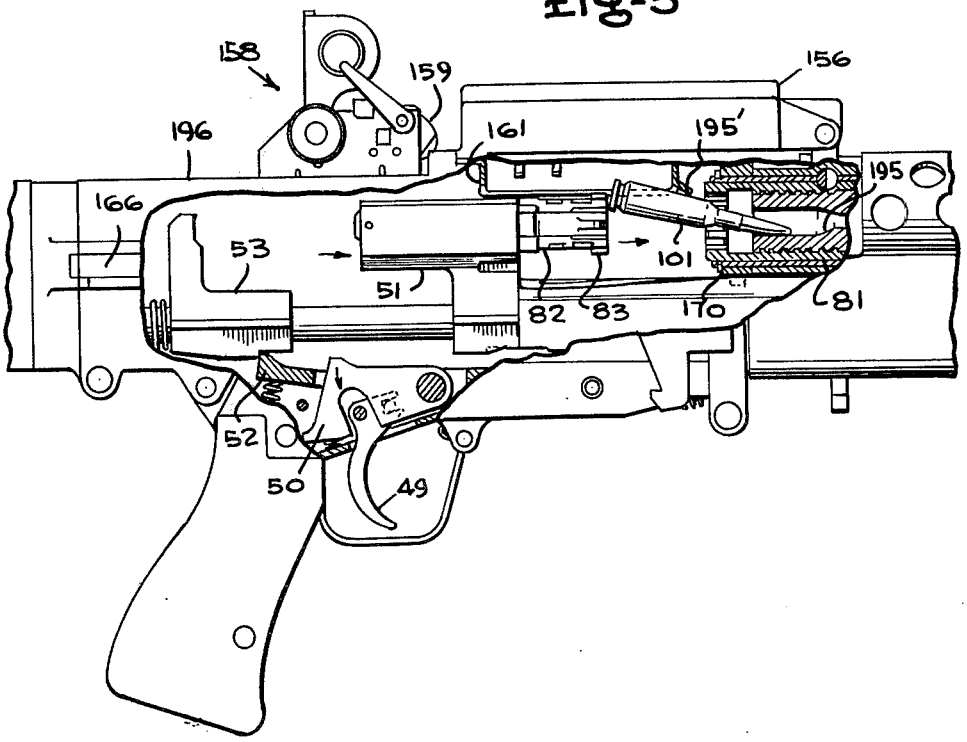

155
156
179
186'
184
176
193
192
191
190
183
185
182
188
188
177
174
175
173
180
187
186
175a
178
180
181
170
20
195
172
199
196
194
161
103
101
102

AMMUNITION MAGAZINE FOR AUTOMATIC FIREARMS

BACKGROUND AND OBJECTS OF THE INVENTION

The invention herein described was made under contract with the Department of the Army of the United States of America.

This is a division, of application Ser. No. 507,997, filed Sept. 20, 1974.

The present invention relates to belt-fed, gas-operated air-cooled, automatic firearms having mechanisms for transferring link-connected rounds from an ammunition magazine to a feed position in an automatic firearm and to sear mechanisms therefor.

In automatic firearms capable of firing at the rates of about 400 to 500 rounds of ammunition per minute, it is essential to have a reliable transfer feed mechanism capable of supplying ammunition and removing a round of ammunition from the ammunition supply carrier such as a link belt and accurately transferring the round to a feed position in front of the bolt carrier without causing a stoppage of the automatic firearm. The rigorous conditions of a battlefield environment demand a high level of performance where success depends on the reliable performance of the automatic firearm.

To prevent the bolt carrier from being prematurely driven away from the barrel when the bolt carrying the round advances to firing position, it is desirable to utilize an anti-bounce sear to lock the bolt carrier in position shortly prior to and during the firing of the round of ammunition. Without an anti-bounce sear, it is possible, as in firearms within the current state of the art to fire a round of ammunition without having the bolt fully locked in the barrel thereby causing a stoppage in the firearm and possible injury to the user.

Prior art automatic firearm transfer mechanisms have been complex, difficult to maintain and subject to numerous stoppages.

A primary object of this invention is to provide an improved ammunition magazine assembly, feed mechanism and anti-bounce sear for automatic firearms which operate more smoothly and efficiently than has occurred in prior art automatic firearms.

Another object of this invention is to provide such an ammunition magazine, a feed mechanism and an anti-bounce sear for automatic firearms which decrease the number of stoppages associated with the feed mechanism to increase the effectiveness of the firearm in a battlefield environment.

An additional object of the present invention is to improve the maintainability of automatic firearms which must be used under adverse field conditions including mud, rain, ice and snow.

A further object of the present invention is to provide an ammunition magazine capable of storing belted rounds of ammunition which may be withdrawn easily without stoppages.

A still further object of the present invention is to provide an ammunition magazine which protects the rounds of ammunition from the environment while providing a visible means for determining the quantity of ammunition remaining in the ammunition magazine.

A still further object of the present invention is to reduce the complexity of feed mechanisms in automatic firearms thereby decreasing cost and the quantities of spare parts which must be maintained.

Another object of the present invention is to provide an anti-bounce sear which prevents the ammunition round from being fired until the bolt carrying the round is locked in a firing position adjacent the rear of the barrel.

An additional object of the present invention is to provide an anti-bounce sear which reduces the possibility of injury to the user of the firearm by preventing firing of the ammunition round until the bolt carrier is locked in the firing position.

These and other objects of the present invention will become apparent from the following description, taken in conjunction with the accompanying drawings.

BRIEF DESCRIPTION OF THE FIGURES

FIG. 2 is a fragmentary elevation showing portions of the bolt carrier and associated components with the bolt carrier in seared position, and showing in dotted lines the bolt advanced into contact with a round of ammunition;

FIG. 3 is an elevation similar to FIG. 2 but with the round of ammunition being chambered;

DETAILED DESCRIPTION OF A PREFERRED EMBODIMENT

Figure 1:
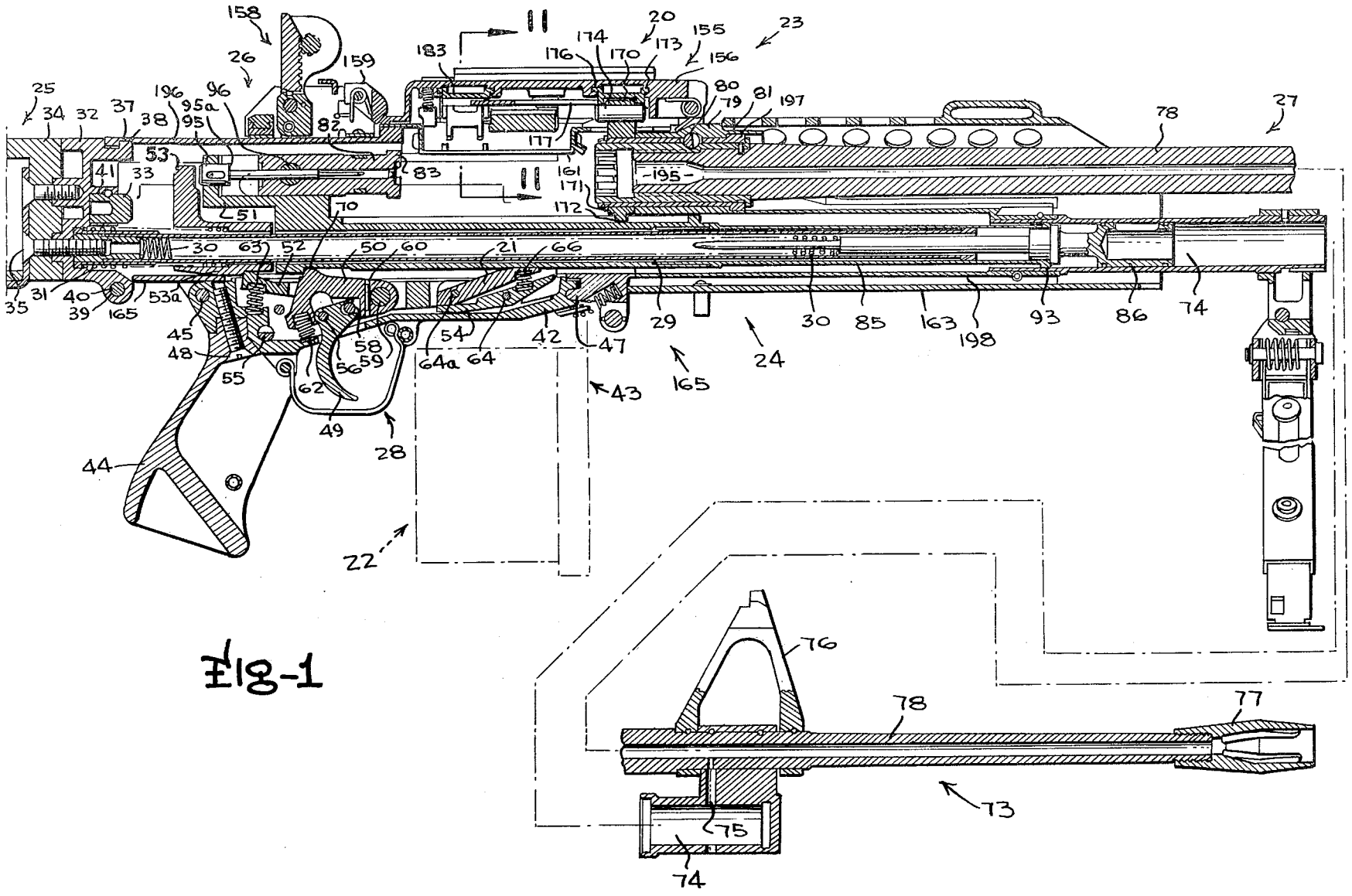
FIG. 1 is a fragmentary sectional elevation of an automatic firearm constructed in accordance with a preferred embodiment of the present invention.
Figure 14:
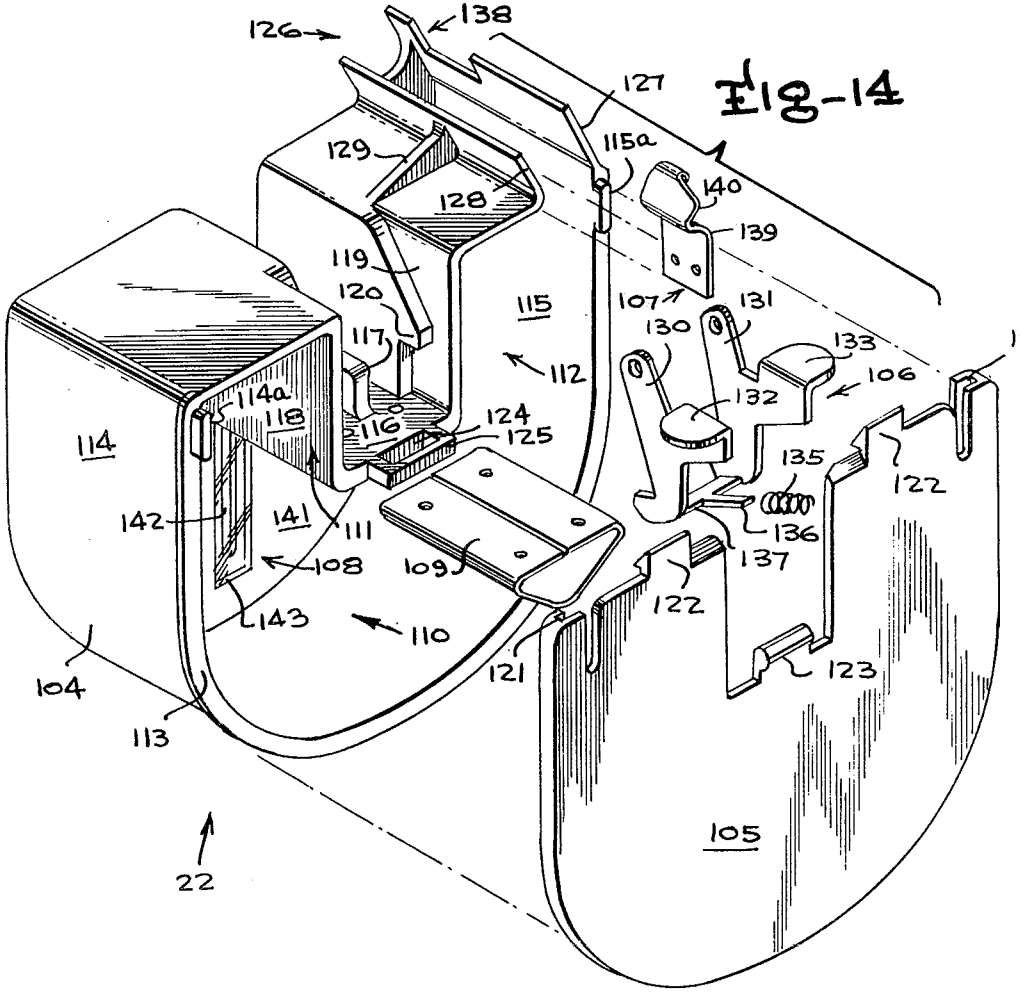
FIG. 14 is an exploded perspective view of an ammunition magazine constructed in accordance with the preferred embodiment of the present invention.

Referring to the Figures and particularly FIGS. 1, 8, 9 and 14 there are illustrated preferred embodiments of the feed transfer mechanism 20, the anti-bounce sear 21 and the ammunition magazine assembly 22 in a lightweight squad automatic machine gun 23, generally comprising, as shown in FIGS. 1 and 14, an operating group 24, a buttstock group 25, a receiver group 26 a barrel group 27 and a sear housing group 28.

The buttstock group 25 comprises a drive spring guide tube 29, a bolt carrier drive spring 30, a striker drive spring 31, a backplate 32, a buffer 33 and a buttstock 34 which is only partially shown in the drawings. The striker drive spring 31 operates over the drive spring guide tube 29 and the bolt carrier drive spring 30 operates within the drive spring guide tube 29 as shown in FIG. 1. The guide tube 29 is secured to the backplate 32 and buttstock 34 by two flat head screws 35 which secures the buttstock 34 to the backplate 32. A lip 37 on the upper surface of the backplate engages a recess 38 in the main receiver body 196 while a mounting hole 39 at the bottom of the backplate 32 provides for engagement of a rear takedown pin 40 on the main receiver body 196. The buffer 33, which may be constructed of energy absorbing elastomer, is mounted in a buffer recess 41 near the center of the backplate.

Figure 8:
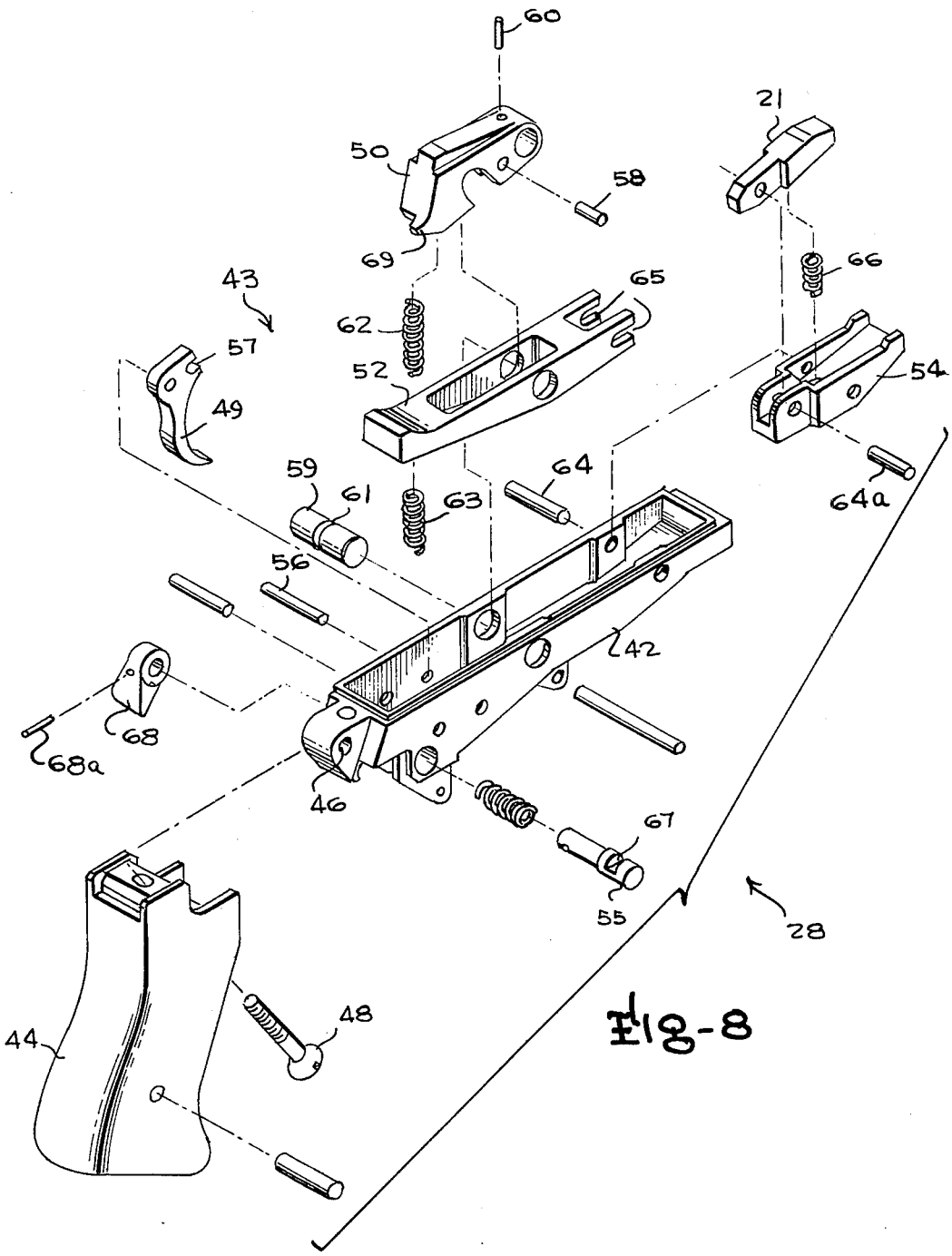
FIG. 8 is an exploded perspective view of a sear housing group utilizing the anti-bounce sear of the present invention.

The sear housing group 28 as shown in FIGS. 1 and 8 comprises a sear housing 42, a fire control mechanism 43, and a pistol grip 44. The sear housing 42 is attachable to the receiver body 196 via a takedown pin 45 inserted in a mounting hole 46 at the rear of the housing and a lug 47 at the forward end of the housing. The pistol grip 44 is fastened to the rear of the sear housing 42 with a flat head screw 48.

The fire control mechanism 43 as shown in FIGS. 1 and 8, comprises a trigger 49, a primary sear 50 which engages a bolt carrier 51, a secondary sear 52 which engages a firing pin striker 53 having a cam shoulder 53a, a secondary sear release link 54, the anti-bounce sear 21 and a safety 55. The trigger 49 pivots about the trigger pivot pin 56 positioned in the sear housing 42. Notch 57 on the trigger 49 engages a trigger pin 58 positioned in the primary sear 50. The primary sear 50 and the secondary sear 52 pivot about the sear pivot pin 59 retained in the sear housing 42 by retainer pin 60 positioned in the sear pivot pin groove 61. As shown in FIG. 1, the primary sear 50 is biased upwardly by a primary sear spring 62 which seats against the sear housing 42 and similarly the secondary sear 52 is biased upwardly by a secondary sear spring 63. The secondary sear link 54 pivots about a secondary sear pivot pin 64 positioned in the sear housing 42.

The anit-bounce sear 21 pivots within the secondary sear release link 54 on a secondary sear actuating pin 64a which extends beyond the sides of the secondary sear link to engage the secondary sear slots 65 in the secondary sear 52. An anti-bounce spring 66 biases the anti-bounce sear 21 upward as shown in FIG. 1 and causes the anti-bounce sear 21 to lock behind the bold carrier 51 when the carrier moves to the right of the anti-bounce sear as shown in FIG. 1. The safety 55 has a slot 67 which permits the primary sear 50 to be operated when safety lever 68 fixed to the safety 55 by retaining pin 68a is rotated to align the slot 67 with the primary sear extension 69. When the safety 55 is in a firing position and the trigger 49 is depressed, the primary sear 50 moves away from the bolt carrier sear notch 70.

A secondary sear cam 71 flanking the bolt carrier sear notch 70 cams the primary sear 50 out of position. Bolt carrier 51 when adjacent the firing position cams the secondary sear link 54 which in turn rotates the secondary sear 52 to move the secondary sear out of the striker sear notch 72.

The barrel group 27 comprises a barrel assembly 73, a gas cylinder 74 having a gas port 75 communicating with the barrel assembly 73, a front sight 76 and a flash suppressor 77. A quick-change barrel 78 is assembled to the receiver by insertion into a receiver bearing block 79 and rotating a barrel lock lever having a rod portion 80 ninety degrees to the position shown in FIG. 4 to engage a barrel extension 81 which is threaded and pinned to the barrel 78. A bolt 82 carried by the bolt carrier 51 locks directly to the barrel extension via breech locking lugs 83 when the carrier advances to firing position.

Figure 10:
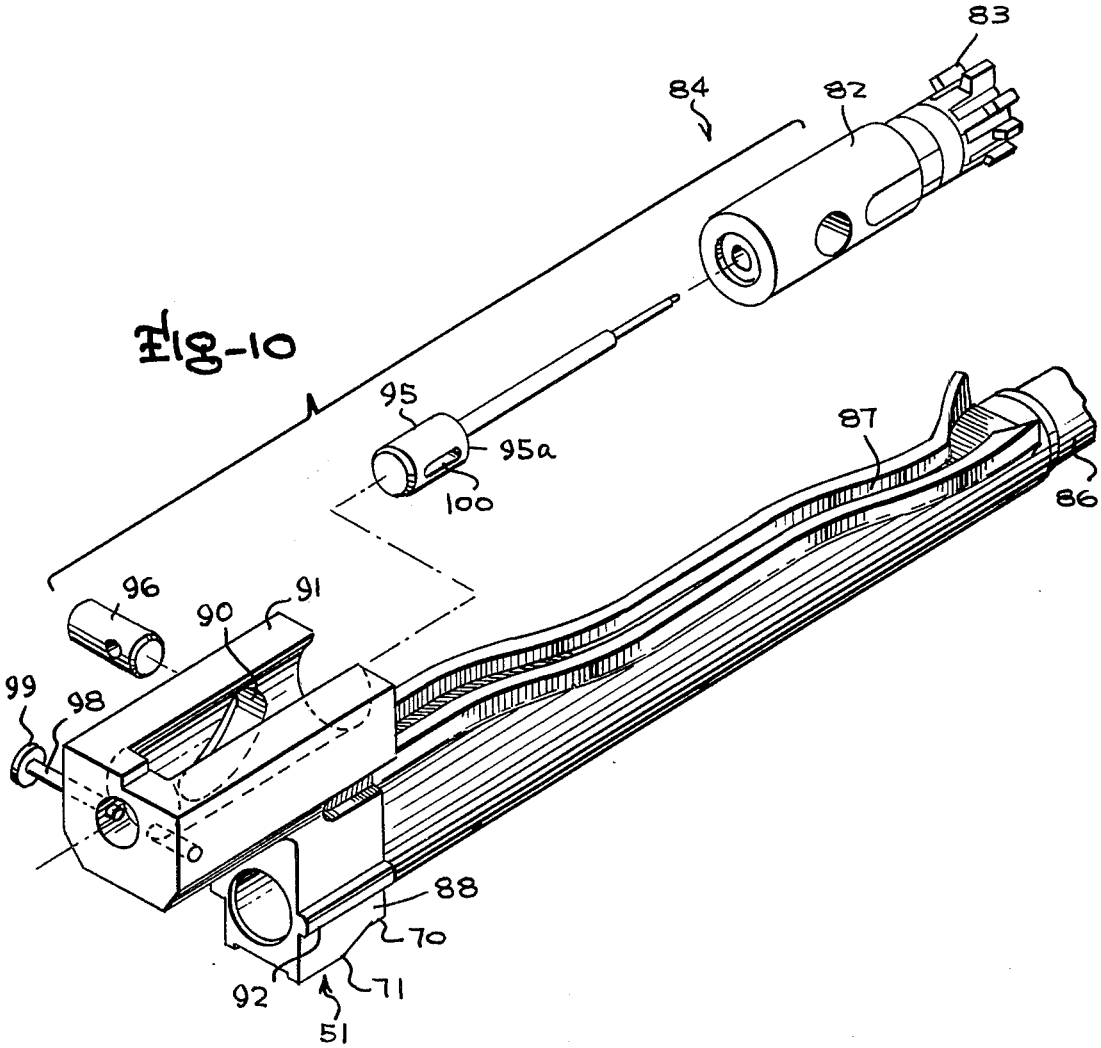
FIG. 10 is an exploded persepctive view of a portion of a bolt carrier and a bolt assembly incorporated in the preferred embodiment.

The operating group 24 shown in FIGS. 1 and 10 comprises the bolt carrier 51, bolt assembly 84 and the firing pin striker 53. The bolt carrier 51 shown is a one-piece fabricated assembly fixed to an integral drive spring guide tube 85 and a gas piston 86 at the forward end. A feed cam 87 is machined on the upper surface of a bolt carrier body 88 and a bolt locking/unlocking cam 90 is machined on the left-hand side of a bolt housing 91 for the bolt 82. The secondary sear cam 71 and the bolt carrier sear notch 70 are located at the underside of the bolt carrier 51. Rails 92 on the bolt carrier slide in keyways in the receiver and a bearing surface 93 behind the gas piston 86 riding in the gas cylinder 74 support the bolt carrier 51 as shown in FIG. 1 as it reciprocates to drive the feed transfer mechanism 20, lock and unlock the bolt assembly 84 and actuate the secondary sear link 54. The bolt assembly as indicated in FIG. 10 is carried by the bolt housing 91 on the bolt carrier 51. A firing pin 95 having a shoulder 95a passes through the rear of the bolt carrier 51, through the bolt 82 and a bolt cam pin 96. The bolt cam pin 96 extends beyond the bolt 82, through the cam slot 90, beyond the bolt carrier 51 and into a guide in the receiver which functions to prevent the bolt from rotating while the bolt is out of the firing position. A firing pin retainer 98, having head 99 for easy removal, passes through the bolt housing 91 and a retainer slot 100 in the firing pin 95 to retain the firing pin in the bolt housing 91 unless the firing pin retainer 98 is removed. The bolt assembly 84 has a conventional spring actuated plunger type ejector and a conventional spring locked extractor having a claw compatible with the ammunition being fired.

Figure 5:
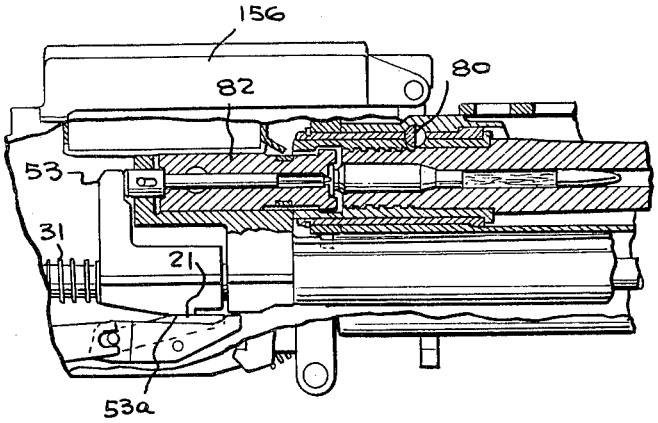
FIG. 5 is a fragmentary elevation with parts broken away showing portions of the bolt carrier, striker and associated components of the preferred embodiment of this invention in the firing position with the anti-bounce sear released and a projectile leaving the barrel.

The firing pin striker 53 has rails on either side which slide in keyways in the receiver and the firing pin striker is seared up by the secondary sear 52. The striker drive spring 31 propels the firing pin striker 53 into impact with the firing pin 95. The forward motion of the striker and firing pin is stopped when a firing pin shoulder 95*a* contacts the bolt to limit firing pin protrusion. As the striker 53 nears the bolt carrier 51, as shown in FIG. 5, a cam shoulder 53*a* cams the anti-bounce sear 21 down to free the bolt carrier 51 to recoil after firing.

Figure 15:
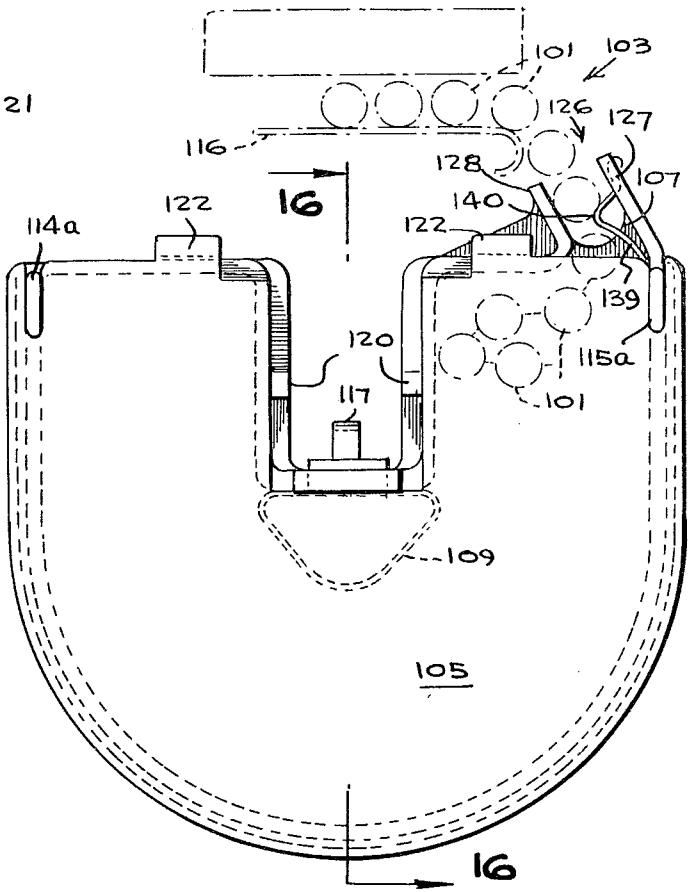
FIG. 15 is a rear elevational view of the ammunition magazine shown in FIG. 14.

The ammunition magazine 22 shown in FIG. 14, 15, 16 and 17 carries rounds of ammunition 101 retained in distintegrating metallic split links 102 connecting the rounds of ammunition together to form an ammunition belt 103 which can be stored in a folded condition in the magazine as shown in FIG. 15. The elements of the magazine assembly 22 include an open ended housing 104, a cover 105, a latch 106, a belt retaining spring 107, a viewing window 108 and a spacer insert 109.

Figure 17:
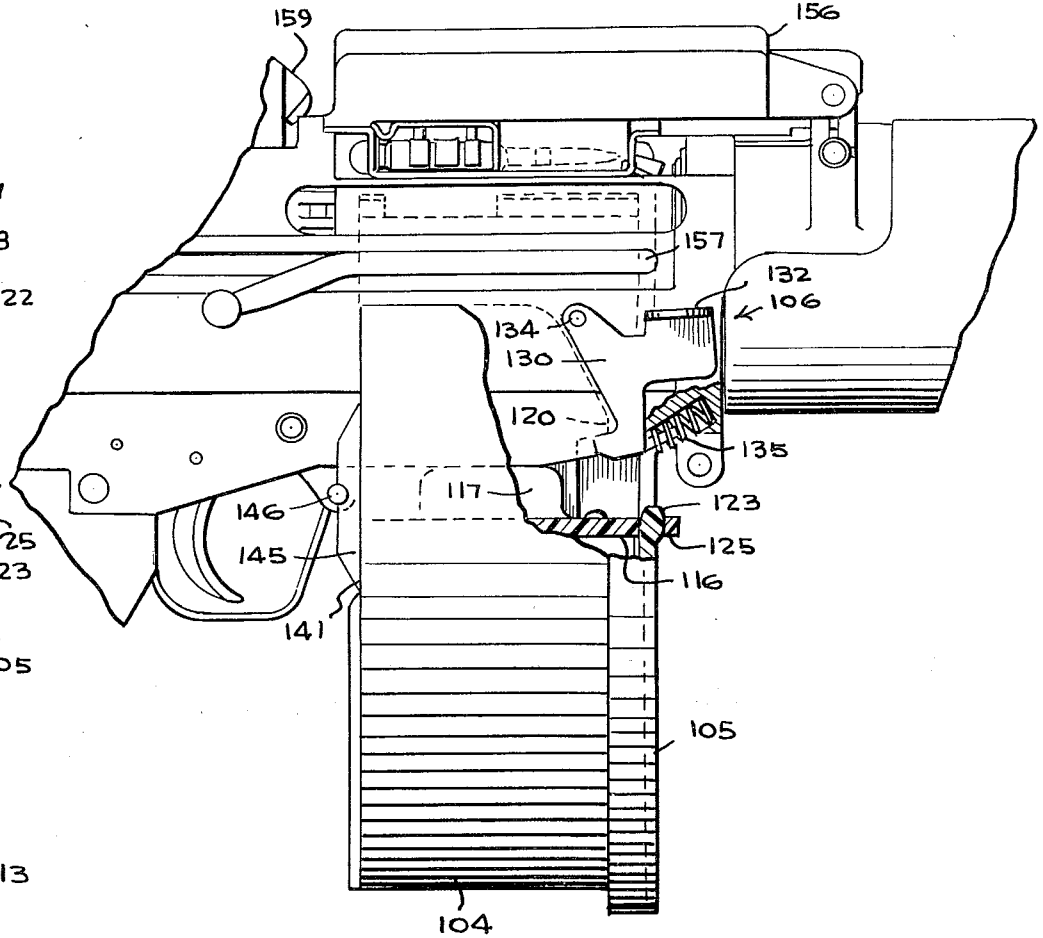
FIG. 17 is a fragmentary elevation of the automatic firearm with the ammunition magazine locked in position.

The open ended housing 104 has a semi-cylindrical lower chamber 110 opening into two rectangular upper chambers 111 and 112 which extend upwardly along the sides of the receiver housing of the firearm when the magazine assembly is installed on the firearm as shown in FIG. 17. A lip 113 extends around the forward edges of the wall surrounding the rectangular upper chambers 111 and 112 and the semi-cylindrical lower chamber 110. Tabs 114*a* and 115*a* extend forwardly from upper side walls 114 and 115 of the upper rectangular chambers 111 and 112. An intermediate connecting wall 116 which connects the inner side walls 118 and 119 of the upper rectangular chambers has an upwardly directed tongue 117 as best shown in FIG. 17 which provides a restraining member to hold the ammunition magazine against axial displacement from the position shown in FIG. 17. The inner walls 118 and 119 have latch notches 120.

In one preferred embodiment, the housing 104 and cover 105 are formed of plastic material by injecting molding of nylon and fiber glass material.

Figure 16:
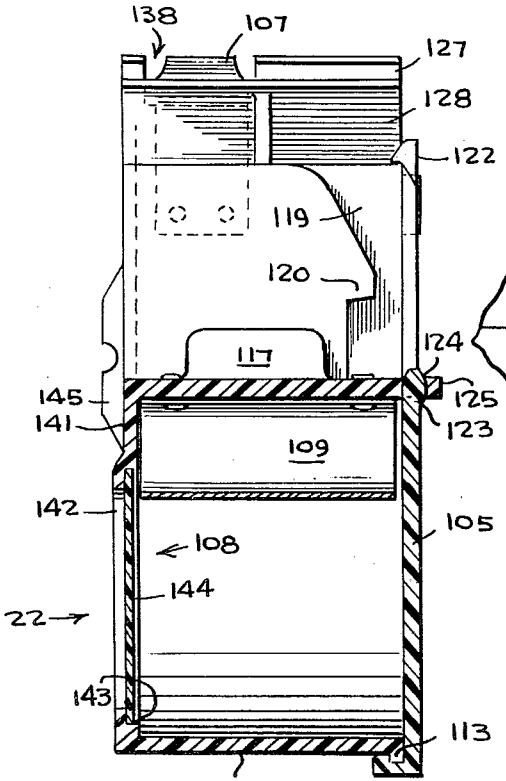
FIG. 16 is a sectional view of the ammunition magazine taken along line 16—16 in FIG. 15.

The cover 105 is provided with a channel 121 as best shown in FIG. 14 which mates with the lip 113 to provide a dust cover for the ammunition stored in the magazine. Retention of the cover 105 on the housing 104 is accomplished with snap tabs 122 which extend above the upper edge of the cover and snap over the upper walls of the upper rectangular chambers 111 and 112 when the cover is properly positioned on the open ended housing as shown in FIGS. 15 and 16. An additional means for retaining the cover on the housing and preventing snap tabs 122 from becoming disengaged includes a retaining tab 123 which extends upwardly from the upper edge of cover 105 and a slot 124 in rearwardly extending tab 125 on wall 116 wherein retaining tab 123 is positioned in slot 124 when the cover 105 is properly installed. A feed slot 126 shown in FIGS. 14 and 15 is formed by an outer guide wall 127 extending inwardly at an angle from outer wall 115 and an inner guide wall 128 extending upwardly from the upper wall of chamber 112. A reinforcing member 129 extends between the inner guide wall 128 and the upper wall of chamber 112 to provide rigidity for the inner guide wall 128.

Latch 106 (best shown in FIGS. 14 and 17) includes two privoted latch members 130 and 131 having outwardly extending tab members 132 and 133 which permit manual retraction of the latch members 130 and 131 when the user desires to remove the magazine from the firearm. The latch members are pivoted about pivot pin 134 shown in FIG. 17 and are biased into engagement with notches 120 by spring 135 compressed between the receiver housing and a T-shaped guide pin 136 which is fixedly attached to latching members 130 and 131 thereby causing simultaneous movement of latching members 130 and 131.

The belt retaining spring 107 is fixedly attached by rivets to outer side wall 115 in the position shown in FIGS. 15 and 16 within a notch 138 in outer guide wall 127. The belt retaining spring 197 has a sharply curved nose joined by a lower curved leg portion 139 which permits the rounds of ammunition 101, as best shown in FIG. 15, passing the belt retaining spring 107 to deflect the spring out of the way and has an upper leg portion 140, approximately perpendicular to lower leg portion 139, which is resiliently urged to a position behind a round of ammunition to prevent the ammunition belt from dropping back into the ammunition magazine. The back wall 141 of the open ended housing contains the viewing window assembly 108 formed by a slot 142 in the rear wall 141 and a retaining recess 143 within which a transparent window panel 114 is retained by adhesive or by a frictional fit. A notched member 145 extends from the rear wall 141 behind each of the upper chambers to mate with a trigger guard pivot pin 146 when the magazine is installed on the firearm. The belt retaining spring 107 holds the round 101 in the feed position; however, the retainer can be moved manually to allow the belted ammunition to be returned into the magazine if desired.

The receiver group 26 shown in FIG. 1 comprises a charging handle assembly 157 (partially shown in FIG. 17), a rear sight assembly 158, a feed cover assembly 155 having a feed cover 156 and the feed transfer mechanism 20, a cover latch 159, a feed tray 161, a front handguard 163, a barrel lock 80, a magazine latch 106 and a receiver assembly 165.

The charging handle assembly 157 is located on the right hand side of the automatic firearm and is guided by a slot 166 (as shown in FIG. 2) in the receiver assembly 165. A lug at the forward end of the charging handle assembly picks up the bolt carrier 51 for charging as the charging handle assembly 157 is pulled to the rear. The charging handle assembly 157 is retained in the forward position by detents and does not reciprocate during firing. The feed cover 156 as shown in FIGS. 1 and 2 is locked in the closed position by a feed cover latch 150.

Figure 9:
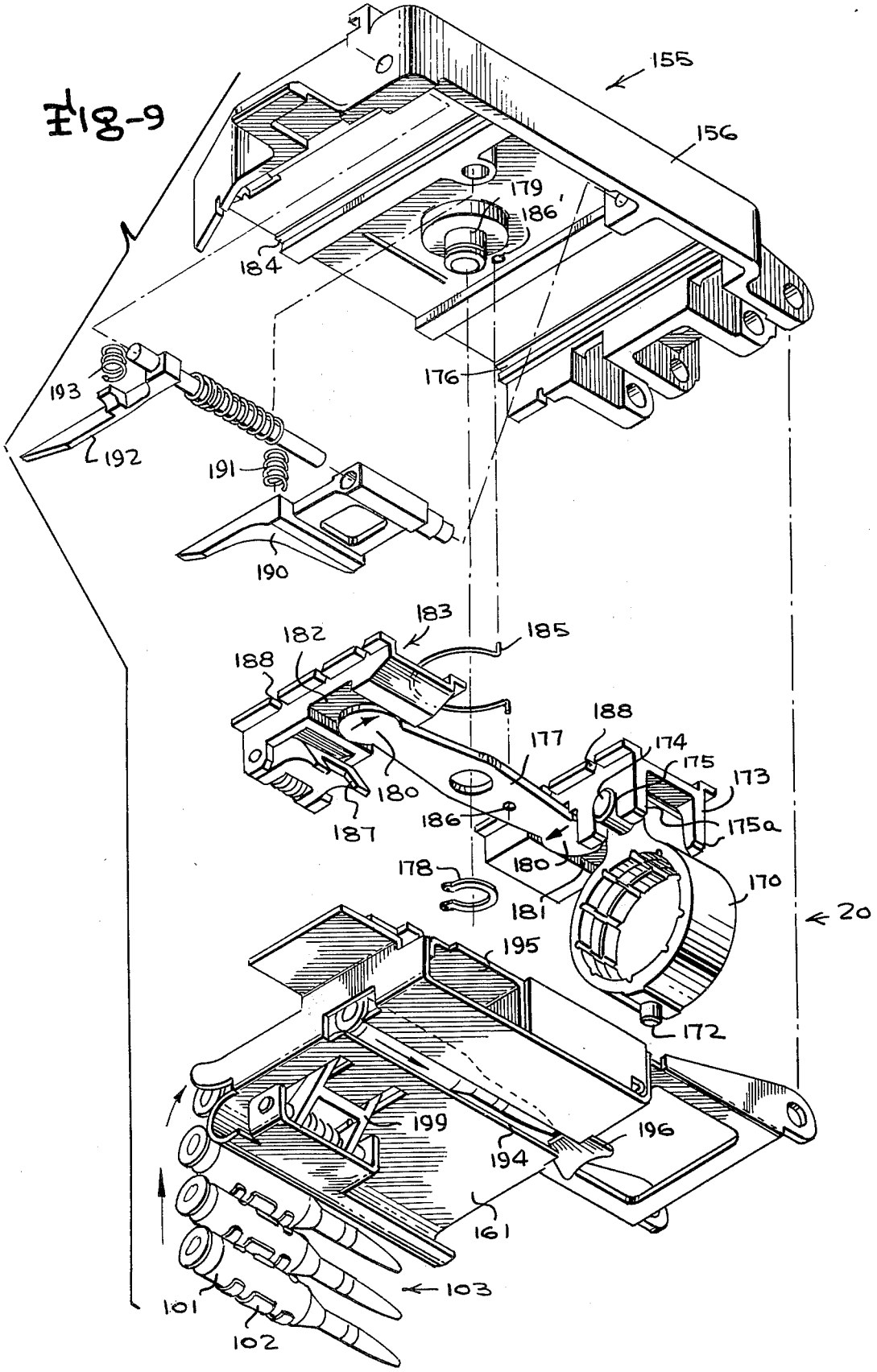
FIG. 9 is an exploded perspective view of the feed drive mechanism and feed tray assembly of the present invention.

The feed transfer mechanism 20 shown in FIGS. 1 and 9, supported on the feed cover 156, is actuated by a rotary feed drive ring 170 which rotates about the barrel extension 81. The feed drive ring is retained on the barrel extension by a retaining ring 171 as shown in FIG. 1. A depending cylindrical lug 172 as shown in FIG. 9 on the lower surface of the drive ring 170 acts as a cam follower to rotate the feed drive ring. The rotary motion of the drive ring is translated into linear motion of a feed actuator slide 173 through a drive pin 174 which engages in downwardly opening slots 175 on the feed actuator slide 173 when the feed cover 156 is closed. The feed actuator slide 173 reciprocates in feed guideways 176 on the feed cover 156. A feed lever 177, retained by a snap ring 178 on a shouldered pivot pin 179 mounted on the feed cover 156, has rounded ends 180 as shown in FIG. 9. One end 180 of the feed lever 177 is free to slide in a feed groove 181 in the feed actuator slide 173 and the other end is free to slide in a pawl slot 182 in a feed pawl slide assembly 183 to be described herein.

Movement of the feed actuator slide 173 is transmitted through the feed lever 177 to the feed pawl slide assembly 183 which reciprocates along a pawl guideway 184 on the feed cover 156. When the feed cover 156 is open, a torsion spring 185 having one end inserted in a hole 186 on the feed lever 177 and a second hole 186' in the feed cover moves the feed slide actuator 173 upwardly as viewed in FIG. 12. In this position, extensions 175*a* on the feed slide actuator interfere with the driive ring 170 if an attempt is made to close the cover and the bolt carrier is not at sear position; therefore; preventing a possible double-feed condition. The feed pawl slide assembly 183 has a spring loaded feed pawl 187 as best shown in FIG. 9, which engages the ammunition round 101 at two points to provide positive alignment with the feed tray 161. Cleaning slots 188 on the feed slide actuator 173 and the feed pawl slide assembly 183 clean the guideways 176 and 184. A front cartridge depressor 190 biased downwardly by a front spring 191 and rear cartridge depressor 192 biased downwardly by a rear spring 193 are pivoted in the feed cover. Both cartridge depressors pivot about an axis parallel to the centerline of the barrel and act to guide and control the incoming belted ammunition. Additionally the cartridge depressors locate and hold the cartridge in a feed groove 194 ready for pickup by the bolt as shown in FIG. 2. The front cartridge depressor 190 holds the split link 102 during stripping and guides the cartridge towards the chamber 195. A spring biased safety pawl 199 shown in FIGS. 9, 11 and 13 retains the first round of ammunition in the feed groove 194 and prevents the ammunition belt from sliding back into the ammunition magazine.

The receiver assembly 165 (FIGS. 1 and 2) includes a main receiver body 196, a barrel sleeve 197, a barrel guide tube 198 and a charging handle. Keyways in the rear of the receiver body 196 guide and support the striker 53 and the rear of the bolt carrier 51. The barrel guide tube 198 internally guides and supports the front of the bolt carrier and forms a continuous cylinder with the barrel gas cylinder 74. The barrel sleeve 197 is pressed and pinned in the main receiver body 196 to form a cavity for the barrel extension 81 and a bearing support for the rotary feed drive ring 170.

The complete operating cycle includes: feeding a round into position in the feed tray groove, stripping the round from the belt, chambering the round in the barrel chamber, locking the bolt inside the barrel extension, firing the round by having the firing pin strike and detonate the cartridge primer, unlocking the bolt from the barrel extension, extracting the empty case from the chamber, ejecting the empty case from the receiver, and charging by engaging the bolt carrier sear notch with the primary sear and engaging the striker with the secondary sear.

Figure 11:
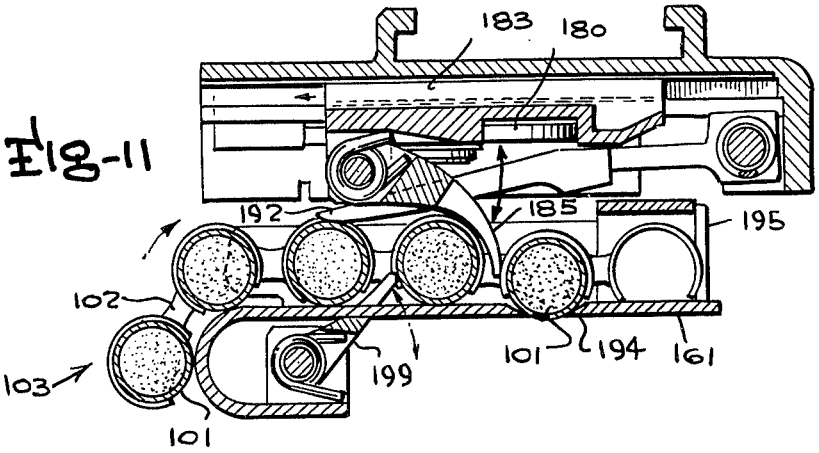
FIG. 11 is a sectional view of the feed mechanism showing the belted ammunition with a round in the feed position taken along line 11—11 in FIG. 1.

The cycle starts by placing the belt of ammunition 103 in the feed tray 161 as shown in FIGS. 9 and 15 and positioning the first round of ammunition over the feed tray groove 194 as shown in FIGS. 9 and 11. Belt retaining spring 107 and spring biased safety pawl 199 prevent the ammunition belt from sliding back into the ammunition magazine 22 or away from the feed groove 194. Actuating the trigger 49 releases the bolt carrier 51 from the seared position as shown in FIG. 2 which allows the bolt carrier 51 and bolt assembly 84 to be driven forward by the expansion of the drive spring 30.

Figure 12:
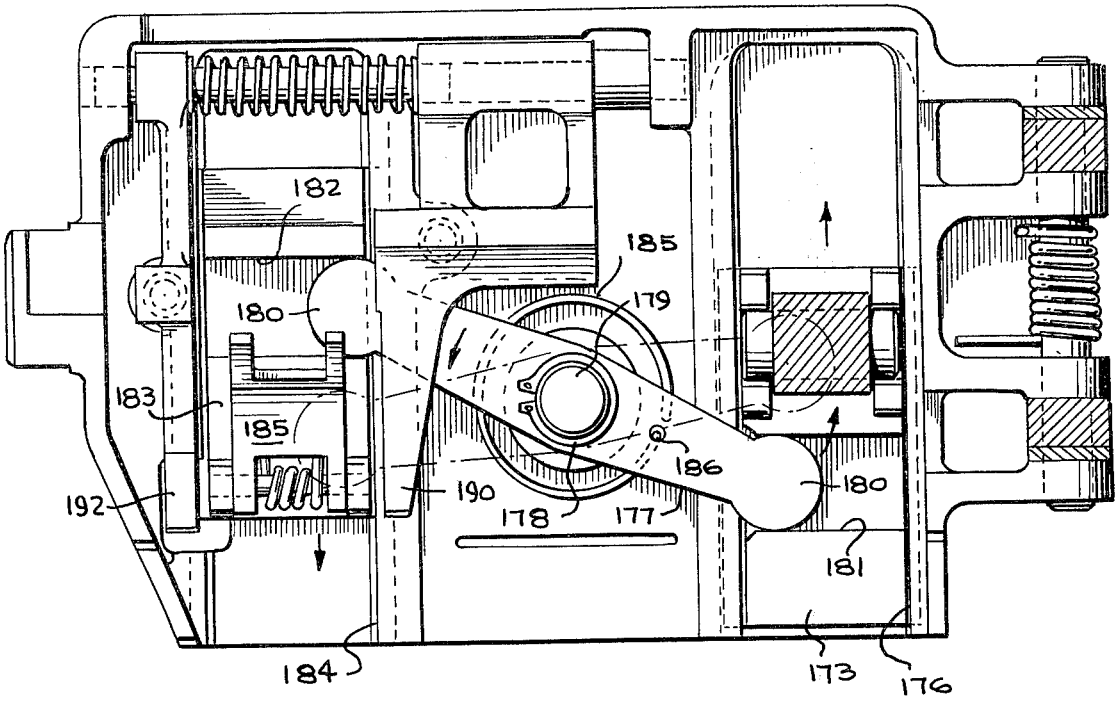
FIG. 12 is a bottom view of the feed mechanism showing the feed transfer mechanism in a position for a round of ammunition to be engaged by the bolt taken along line 12—12 in FIG. 2.
Figure 13:
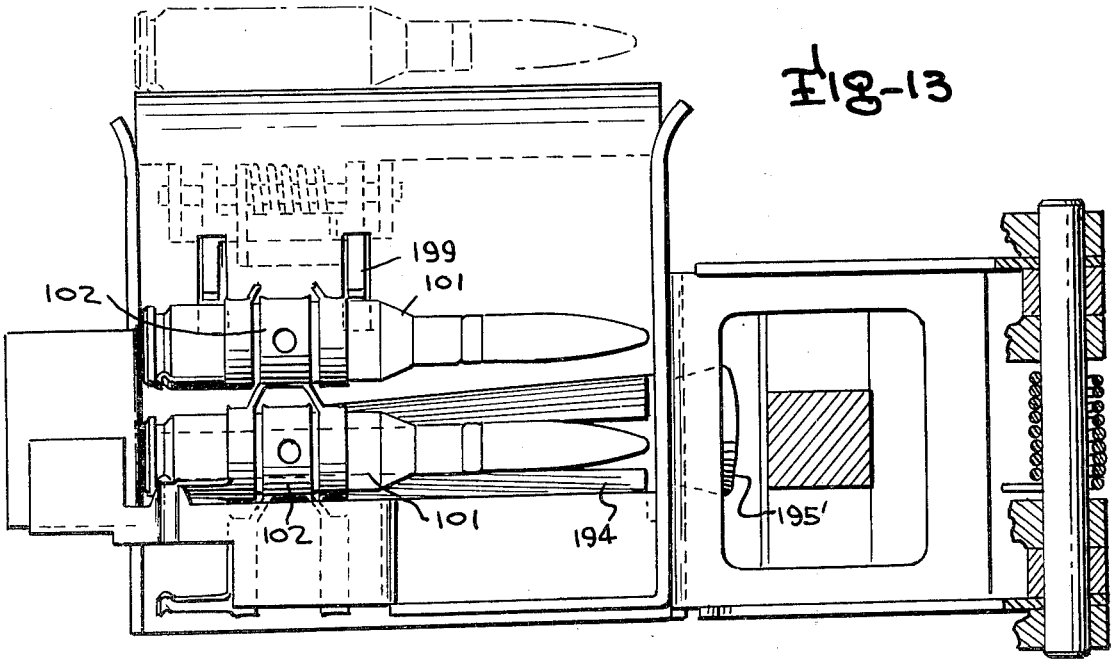
FIG. 13 is a top view of the feed tray and rounds of ammunition showing the pivot and support for the feed tray taken along line 13—13 in FIG. 2.

As the bolt carrier 51 moves forward, the feed cam 87 shown in FIG. 10 causes the feed ring 170 to rotate clockwise (as viewed from the rear of the firearm) causing movement of the actuator slide feed lever 177 and feed slide pawl assembly 183 as shown in FIGS. 11 and 12. The feed pawl 185 moves into position behind the next round in the belt, ready to index the round to the feed tray groove 194 when recoil movement begins. As the bolt carrier 51 recoils after firing, the feed ring 170 is rotated counter-clockwise by the feed cam 87. This action causes the feed pawl slide assembly 183 to move in the opposite direction, thereby pushing a round 101 into the feed tray groove 194 and forcing an empty link 102 through a link guide 195 on the feed tray.

As the bolt assembly 84 travels forward, the bolt 82 engages the base of the cartridge 101 as shown in dotted lines in FIG. 2. The downward pressure of the front and rear cartridge depressors 190 and 192 hold the round in positive contact with the bolt assembly. The front cartridge depressor 190 also prevents forward motion of the links 102 as the round 101 is stripped from the belt by the forward motion of the bolt 82. When the nose of the round contacts a chambering ramp 196 on the feed tray, the round is deflected downward and into the barrel extension 81 as shown in FIG. 3.

Figure 4:
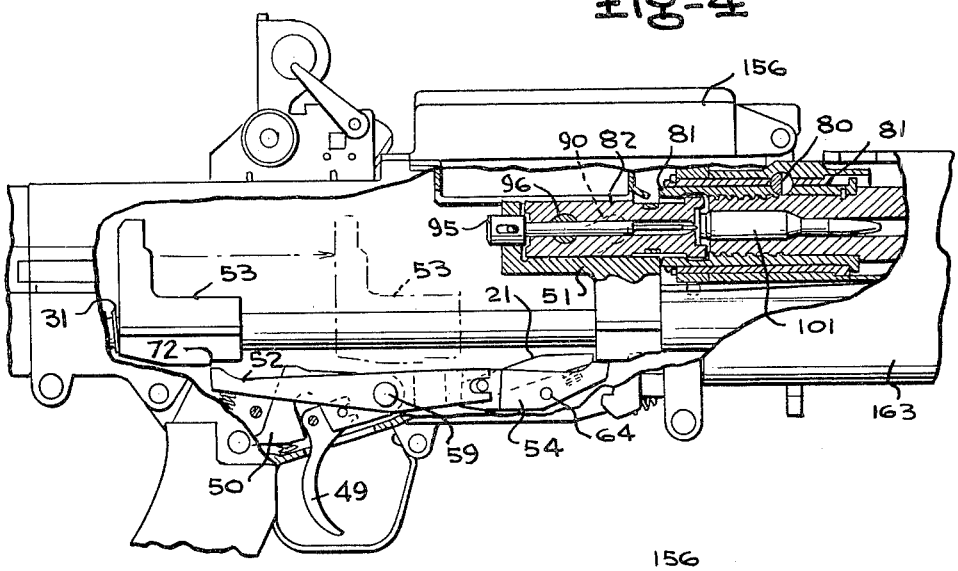
FIG. 4 is an elevation similar to FIG. 2 but with the firearm locked, the striker released and the anti-bounce sear in position.

The round 101 then continues into the chamber 195 until it is fully seated and the base of the round is flush with the face of the bolt 82 as shown in FIG. 4. When the round 101 is fully seated in the chamber 195 the extractor snaps over the rim of the cartridge and the ejector is depressed flush with the face of the bolt. As the round is chambered, the bolt enters the barrel extension 81. The locking action of the bolt cam pin 96 against the cam slot 90 on the bolt carrier causes the bolt to rotate 22 ½° in a counter-clockwise direction completely locking the bolt as shown in FIG. 4.

As the bolt carrier nears the firing position, the secondary sear cam 71 actuates the secondary sear 52 and allows the striker 53 to move forward. The anti-bounce sear 21 moves up behind the bolt carrier 51 as the bolt carrier contacts the barrel extension 81 (shown in FIG. 4). The striker 53 is driven forward by the expansion of the striker spring 31 until the striker impacts the rear of the firing pin 95 which then moves forward through an aperture in the face of the bolt striking the cartridge primer and causing detonation (FIG. 8).

Figure 6:
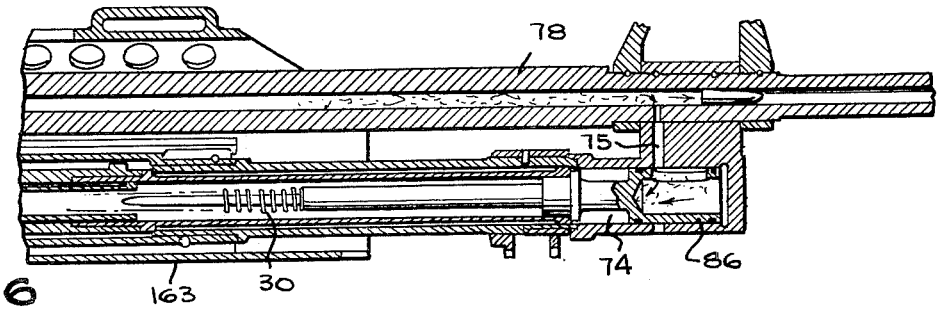
FIG. 6 is a fragmentary sectional elevation of the barrel and bolt carrier retraction gas piston in the preferred embodiment of the present invention with a projectile having passed a gas port providing communication between the gases behind the projectile and the gas piston.
Figure 7:
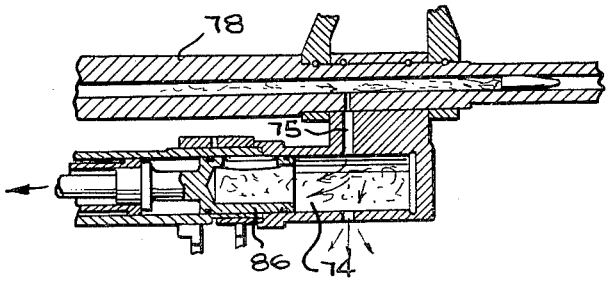
FIG. 7 is a view similar to FIG. 6 but with the gas piston retracted past the exhaust port thereby providing communication between the atmosphere and the gases.

The striker 53 cams the anti-bounce sear 21 out of position behind the bolt carrier 51 (shown in FIG. 5) as the striker reaches the firing position. After the round has ignited and the projectile passes the gas port 75, (shown in FIGS. 6 and 7) expanding gases enter the gas cylinder 74 through the gas port 75. These rapidly expanding gases act upon a face of the gas piston 86 at the forward end of the bolt carrier 51 and force it to the rear to the position shown in FIG. 2.

As the bolt carrier recoils, the bolt cam pin 96 acts against the cam slot 90 in the bolt carrier 51 causing the bolt to rotate clockwise 22 ½° thus unlocking the bolt from the barrel extension 81. As soon as unlocking is complete, the bolt carrier carries the bolt rearward and the extractor pulls the cartridge from the chamber. As the cartridge is withdrawn from the chamber 195 the ejector expands and pushes the base of the cartridge case to pivot the case around the extractor. This action causes the case to spin out of the receiver through the ejection slot on the right hand side of the firearm.

During recoil the bolt carrier 51 and the striker 53 are carried rearward and bolt carrier drive spring 30 and striker drive spring 31 are compressed. Rearward movement of the feed cam 87 on the bolt carrier 51 causes the feed drive ring 170 to rotate counter-clockwise (as viewed from the rear of the firearm) causing the feed pawl 185 to slide back over the next round 101 to be fired. As long as the trigger 49 is depressed, the bolt carrier will not sear up; however, the striker engages the secondary sear each cycle. When the trigger is released and the primary sear 50 moves into position to engage the bolt carrier, firing will cease.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the dependent claims.

I claim:

1. An ammunition magazine for storing rounds of ammunition retained in a split link belt and for supplying the rounds to a firearm, said ammunition magazine comprising a magazine housing including an open ended housing member having an end wall and side walls defining a chamber for housing the split link belt in a folded condition and a removable cover member closing the open end of the housing member, lock means for retaining the cover member in closing position over the open end of the housing member to protect the ammunition from the environment and for keeping the ammunition stacked in an orderly fashion, the magazine housing having latch formations for attachment of the ammunition magazine to the firearm, means defining a feed outlet from the housing including upwardly inclined substantial parallel spaced flange walls directed to guide the ammunition belt along an upwardly inclined path into the belt receiving portion of the firearm, belt restraining means in the feed outlet for preventing the ammunition belt from sliding back into the ammunition magazine if the ammunition belt is released from the firearm, the open ended housing member defining a semicylindrical lower chamber and two separate rectangular upper chambers opening into the semicylindrical lower chamber and having a connecting wall between said upper rectangular chambers defining a central upper wall for the semicylindrical lower chamber, said lock means comprising snap tabs extending upwardly from the upper edge of the cover member and having a rearwardly directed projection which snaps over an upper wall bounding the upper rectangular chambers when the cover member is installed on the housing member, and said connecting wall having a slot and the cover member having an upwardly extending tongue formation with a projection which mates with and is retained by the slot in the connecting wall.

2. The ammunition magazine of claim 1, wherein the housing member has a lip extending around portions of the outer and lower edges of the wall portion surrounding the rectangular upper chambers and the semi-cylindrical lower chamber, and the cover member includes an inwardly directed channel around the outer edges of the cover means to mate with the lip portions on the housing member when the cover member is installed on the open ended housing.

3. The apparatus of claim 1 wherein the latch formation includes means defining a latch shoulder on the housing member, the firearm having a latching lever pivoted on the firearm and engagable with the latch shoulder on the housing member, a biasing spring between the firearm and the latching lever to bias the latching lever into contact with the latch shoulder, and a tab extending from the latching lever for manual engagement to permit a manual retraction of the latching lever.

4. The ammunition magazine of claim 1 wherein the housing member has a slot in an end wall thereof and a transparent window panel covering the slot for permitting viewing of the ammunition belt in the housing and preventing the entry of foreign matter into the magazine.

5. The ammunition magazine of claim 2 additionally including a spacer insert means removably positioned inwardly against the connecting wall between the upper rectangular chambers and having a generally triangular cross-sectional configuration formed of resilient material for preventing jamming of the split link belt of ammunition as it is withdrawn from the ammunition magazine.

6. The ammunition magazine of claim 5 wherein the belt retaining means comprises a spring member positioned against a wall flange of the feed outlet having a sharply curved central nose portion extending into the path of the rounds moving through said feed outlet to be engaged by the rounds of ammunition for deflecting the spring member out of the path of the ammunition and having a leg portion extending at an angle to the curved central nose portion which extends into spaces between the rounds to prevent the ammunition belt from dropping back into the ammunition magazine.

7. An ammunition magazine for storing rounds of ammunition retained in a split link belt and for supplying the rounds to a firearm, said ammunition magazine comprising a magazine housing including an open ended housing member having an end wall and side walls defining a chamber for housing the split link belt in a folded condition and a removable cover member closing the open end of the housing member, lock means for retaining the cover member in closing position over the open end of the housing member to protect the ammunition from the environment and for keeping the ammunition stacked in an orderly fashion, the magazine housing having latch formations for attachment of the ammunition magazine to the firearm, means defining a feed outlet from the housing including upwardly inclined substantial parallel spaced flange walls directed to guide the ammunition belt along an upwardly inclined path into the belt receiving portion of the firearm, belt restraining means in the feed outlet for preventing the ammunition belt from sliding back into the ammunition magazine if the ammunition belt is released from the firearm, the open ended housing member defining a semicylindrical lower chamber and two separate rectangular upper chambers opening into the semicylindrical lower chamber and having a connecting wall between said upper rectangular chambers defining a central upper wall for the semicylindrical lower chamber, the housing member having a lip extending portions of the outer and lower edges of the wall portion surrounding the rectangular upper chambers and the semicylindrical lower chamber, and the cover member including an upwardly directed channel around the outer edges of the cover means to mate with the lip portions on the housing member when the cover member is installed on the open ended housing, the magazine including a spacer insert means removably positioned inwardly against the connecting wall between the upper rectangular chambers and having a generally triangular cross-sectional configuration formed of resilient material for preventing jamming of the split link belt of ammunition as it is withdrawn from the ammunition magazine.

8. The ammunition magazine of claim 7 wherein the belt retaining means comprises a spring member positioned against a wall flange of the feed outlet having a sharply curved central nose portion extending into the path of the rounds moving through said feed outlet to be engaged by the rounds of ammunition for deflecting the spring member out of the path of the ammunition and having a leg portion extending at an angle to the curved central nose portion which extends into spaces between the rounds to prevent the ammunition belt from dropping back into the ammunition magazine.

9. An ammunition magazine for storing rounds of ammunition retained in a split link belt and for supplying the rounds to a firearm, said ammunition magazine comprising a magazine housing including an open ended housing member having an end wall and side walls defining a chamber for housing the split link belt in a folded condition and a removable cover member closing the open end of the housing member, lock means for retaining the cover member in closing position over the open end of the housing member to protect the ammunition from the environment and for keeping the ammunition stacked in an orderly fashion, the magazine housing having latch formations for attachment of the ammunition magazine to the firearm, means defining a feed outlet from the housing including upwardly inclined substantial parallel spaced flange walls directed to guide the ammunition belt along an upwardly inclined path into the belt receiving portion of the firearm, belt restraining means in the feed outlet for preventing the ammunition belt from sliding back into the ammunition magazine if the ammunition belt is released from the firearm, the open ended housing member defining a semicylindrical lower chamber and two separate rectangular upper chambers opening into the semicylindrical lower chamber and having a connecting wall between said upper rectangular chambers defining a central upper wall for the semicylindrical lower chamber, the belt retaining means comprising a spring member positioned against a wall flange of the feed outlet having a sharply curved central nose portion extending into the path of the rounds moving through said feed outlet to be engaged by the rounds of ammunition for deflecting the spring member out of the path of the ammunition and having a leg portion extending at an angle to the curved central nose portion which extends into spaces between the rounds to prevent the ammunition belt from dropping back into the ammunition magazine.

10. The ammunition magazine as defined in claim 9, including spacer insert means removably positioned inwardly against the connecting wall between the upper rectangular chambers and having a generally triangular cross-sectional configuration formed of resilient material for preventing jamming of the split link belt of ammunition as it is withdrawn from the ammunition magazine.

* * * * *